US006607052B2

(12) United States Patent
Brandt et al.

(10) Patent No.: US 6,607,052 B2
(45) Date of Patent: Aug. 19, 2003

(54) MUFFLER SHELL FILLING PROCESS AND MUFFLER FILLED WITH FIBROUS MATERIAL

(75) Inventors: Luc J. L. Brandt, Henri-Chapelle (BE); Leon Charlier, Battice (BE)

(73) Assignee: Owens Corning Composites SPRL, Brussels (BE)

( * ) Notice: Subject to any disclaimer, the term of this patent is extended or adjusted under 35 U.S.C. 154(b) by 0 days.

(21) Appl. No.: 09/952,004

(22) Filed: Sep. 12, 2001

(65) Prior Publication Data

US 2003/0047381 A1 Mar. 13, 2003

(51) Int. Cl.[7] ..... F01N 1/24
(52) U.S. Cl. ..... 181/256; 181/252
(58) Field of Search ..... 181/252, 256, 181/258, 282

(56) References Cited

U.S. PATENT DOCUMENTS

| | | | | |
|---|---|---|---|---|
| 3,921,273 | A | 11/1975 | Kondo et al. | |
| 4,569,471 | A | 2/1986 | Ingemansson et al. | |
| RE32,258 | E | 10/1986 | Kondo et al. | |
| 4,774,985 | A | 10/1988 | Broadbelt et al. | |
| 5,036,585 | A | 8/1991 | Schweinfurth | |
| 5,398,407 | A | 3/1995 | Stuer | |
| 5,461,777 | A | 10/1995 | Ikeda et al. | |
| 5,479,706 | A | 1/1996 | Tamano et al. | |
| 5,766,541 | A | 6/1998 | Knutsson et al. | |
| 5,784,784 | A | 7/1998 | Flanigan et al. | |
| 5,859,394 | A | 1/1999 | Seehaus et al. | |
| 5,907,904 | A | 6/1999 | Gerber et al. | |
| 5,976,453 | A | 11/1999 | Nilsson et al. | |
| 6,053,276 | A | 4/2000 | D'Amico, Jr. et al. | |
| 6,068,082 | A | 5/2000 | D'Amico, Jr. et al. | |
| 6,094,817 | A | 8/2000 | Shah et al. | |
| 6,148,519 | A | 11/2000 | Stenersen et al. | |
| 6,158,547 | A | 12/2000 | Ackermann et al. | |
| 6,412,596 | B1 * | 7/2002 | Brandt et al. | 181/256 |
| 6,446,750 | B1 * | 9/2002 | Lewin | 181/256 |

FOREIGN PATENT DOCUMENTS

| | | |
|---|---|---|
| EP | 0 106 481 | 4/1984 |
| GB | 986377 | 3/1965 |
| GB | 2 267 731 | 12/1993 |
| WO | 98 24615 | 6/1998 |

* cited by examiner

*Primary Examiner*—Khanh Dang
(74) *Attorney, Agent, or Firm*—Inger H. Eckert; James J. Dottavio

(57) ABSTRACT

A process is provided for filling a muffler shell with fibrous material. It comprises the step of providing a muffler shell comprising one or more muffler shell outer parts which define an internal cavity and an internal structure adapted to extend at least part way through the shell internal cavity and having one or more openings adapted to communicate with the shell internal cavity. The process further comprises the step of providing a bag filled with fibrous material. The bag has a first side with one or more first perforations defining a first side total open area and a second side with either no perforations or one or more second perforations defining a second side total open area. The first open area is greater than the second open area. The process also comprises the steps of positioning the fibrous material-filled bag adjacent the internal structure such that the first side is nearest to the internal structure, and drawing a partial vacuum through the internal structure, the partial vacuum drawing the fibrous-filled bag inwardly towards the internal structure.

17 Claims, 6 Drawing Sheets

40b
60
42b
45c

45a 44a
40b
60
42a
45a
45b
44a 20a
24

20b
18
26
20b
20
22
20b 50
40a 24
42b
40b
20a
26.
V
52a
40c
52
18

MUFFLER SHELL FILLING PROCESS AND MUFFLER FILLED WITH FIBROUS MATERIAL

TECHNICAL FIELD AND INDUSTRIAL APPLICABILITY OF THE INVENTION

This invention relates to a process for filling a muffler shell with fibrous material, and a muffler shell filled with fibrous material.

BACKGROUND OF THE INVENTION

U.S. Pat. No. 4,569,471 to Ingemansson et al. describes a process and apparatus for feeding lengths of a continuous glass fiber strand into a muffler outer shell. The apparatus includes a texturizing device with a nozzle for expanding the fiber strand into a wool-like material before the material enters the outer shell. In a first embodiment, filling of an outer cylinder 14 of the muffler shell occurs without an end-piece joined to the outer cylinder 14. After the filling operation is completed, the outer cylinder 14 is moved to a separate station where the end piece is welded onto the outer cylinder 14. In a second embodiment, illustrated in FIG. 3, a perforated pipe/outer end piece assembly is located only part way in the muffler outer cylinder 14 during the glass material filling operation. After the filling operation has been completed, the perforated pipe/end piece assembly is moved to its final position within the outer cylinder 14.

The '471 patent process is typically not used with clam shell mufflers comprising first and second halves which, when coupled together and enclosing a perforated pipe, may not have an open end through which fibrous material may be fed.

It is also known in the prior art to form preforms from glass material which are adapted to be inserted into a first muffler shell section prior to it being coupled to a corresponding second shell section; see U.S. Pat. No. 5,766,541, the disclosure of which is incorporated herein by reference. While such preforms are acceptable in performance, they add additional cost to the muffler due to the manufacturing steps necessary to form the preforms.

It is also known to fill bags or a mesh with fibrous material. The filled bag or mesh is then inserted into a first muffler shell section prior to the first shell section being coupled to a second shell section, see U.S. Pat. No. 6,068,082, the disclosure of which is incorporated herein by reference. However, assembly of such mufflers is oftentimes difficult and time consuming due to the expanded nature of the filled bag and limited volume within the muffler shell outer parts. It is noted that any fibrous material extending out beyond the outer edges of the first and second muffler shell outer parts may have a detrimental impact on a weld at that point, i.e., may cause a void in the weld, and exposed fibers are aesthetically undesirable.

Hence, there is a need for an improved, low-cost muffler outer shell filling process which can be used to fill muffler shells.

SUMMARY OF THE INVENTION

In accordance with a first aspect of the present invention, a process is provided for filling a muffler shell with fibrous material. The process comprises the steps of: providing a muffler shell comprising one or more muffler shell outer parts which define an internal cavity and an internal structure adapted to extend at least part way through the shell internal cavity and having one or more openings adapted to communicate with the shell internal cavity; providing a bag filled with fibrous material, the bag having a first side with one or more first perforations defining a first side total open area and a second side with either no perforations or one or more second perforations defining a second side total open area, the first open area being greater than the second open area; positioning the fibrous material-filled bag adjacent the internal structure such that the first side is nearest to the internal structure; and drawing a partial vacuum through the internal structure, the partial vacuum drawing the fibrous-filled bag inwardly towards the internal structure.

The partial vacuum may be drawn prior to or at about the same time as the occurrence of the positioning step. The partial vacuum may also be drawn subsequent to the positioning step.

The muffler shell may comprise first and second muffler shell outer parts. The process may further comprise the steps of: placing the internal structure in the first muffler shell outer part subsequent to the positioning step and while the partial vacuum is being drawn through the internal structure; placing the second muffler shell outer part adjacent to the first muffler shell outer part while the partial vacuum is still being drawn through the internal structure such that the first and second muffler shell parts define an internal cavity containing the internal structure, and the fibrous material-filled bag; and joining the first and second muffler shell parts to one another. Alternatively, the process may further comprise the steps of: placing the internal structure in the first muffler shell outer part prior to the positioning step; placing the second muffler shell outer part adjacent to the first muffler shell outer part subsequent to the positioning step such that the first and second muffler shell parts define an internal cavity containing the internal structure, and the fibrous material-filled bag; and joining the first and second muffler shell parts to one another.

The fibrous material in the bag may comprise a mineral fiber wool-type product.

The step of drawing a partial vacuum through the internal structure may comprise the step of connecting a vacuum source to the internal structure.

The bag may be formed from paper, cardboard, fiberglass, a polymeric material or any other suitable material.

The internal structure may comprise at least one perforated element such as a perforated pipe.

The first side total open area may comprise between about 1% and about 60% of the total surface area of the first side of the bag and the second side total open area may comprise between about 0% and about 4% of the total surface area of the second side of the bag. Accordingly, between about 40% and about 99% of the total surface area of the first side of the bag comprises a solid, non-open area and is defined by the material from which the bag is formed and between about 96% and about 100% of the total surface area of the second side of the bag comprises a solid, non-open area and is defined by the bag material. Hence, the "total surface area" of the first side of the bag includes open and non-open areas and the "total surface area" of the second side of the bag includes open and non-open areas.

The muffler shell may alternatively comprise a generally cylindrical main shell portion and opposing end caps. One of the end caps may be integral with the main shell portion or the internal structure, while the other end cap is adapted to be coupled such as by welding or crimping to the cylindrical main shell portion. Alternatively, both end caps may be formed as separate parts from the main shell portion. The method may further comprise the step of placing the internal structure in the generally cylindrical main shell portion subsequent to the positioning step and while the partial vacuum is being drawn through the internal structure.

In accordance with a second aspect of the present invention, a muffler is provided comprising a muffler shell including one or more muffler shell outer parts which define an internal cavity; an internal structure adapted to extend at least part way through the shell internal cavity and having one or more openings communicating with the shell internal cavity; and a fibrous-filled bag positioned in the internal cavity, the bag having a first side with one or more first perforations defining a first side total open area and a second side with either no perforations or one or more second perforations defining a second side total open area, the first open area being greater than the second open area.

The internal structure may comprise at least one perforated element.

The fibrous material may comprise a mineral fiber wool-type product.

The first side total open area may comprise between about 1% to about 60% of the first side of the bag and all ranges subsumed therein and the second side total open area may comprise between about 0% to about 4% of the second side of the bag, all ranges subsumed therein, and preferably between about 0% to about 0.5% of the second side of the bag.

Advantages associated with the present invention include: improved bag placement within the internal cavity due to the creation of a partial vacuum in the internal structure; reduction in time required to fill a muffler shell with fibrous material; muffler shell filling may occur without tape to maintain a fibrous material-filled bag in position within the muffler shell or a texturizing device if the bags to be placed within the muffler shell have been previously filled with fibrous material; improved muffler acoustic attenuation properties due to proper location and compaction of the fibrous material around and against the internal structure.

DETAILED DESCRIPTION AND PREFERRED EMBODIMENTS OF THE INVENTION

A process is provided for filling mufflers with fibrous material via fibrous material-filled bags. Mufflers filled in accordance with the present invention are capable of being incorporated into vehicle exhaust systems and function as acoustic attenuators.

Figure 5:
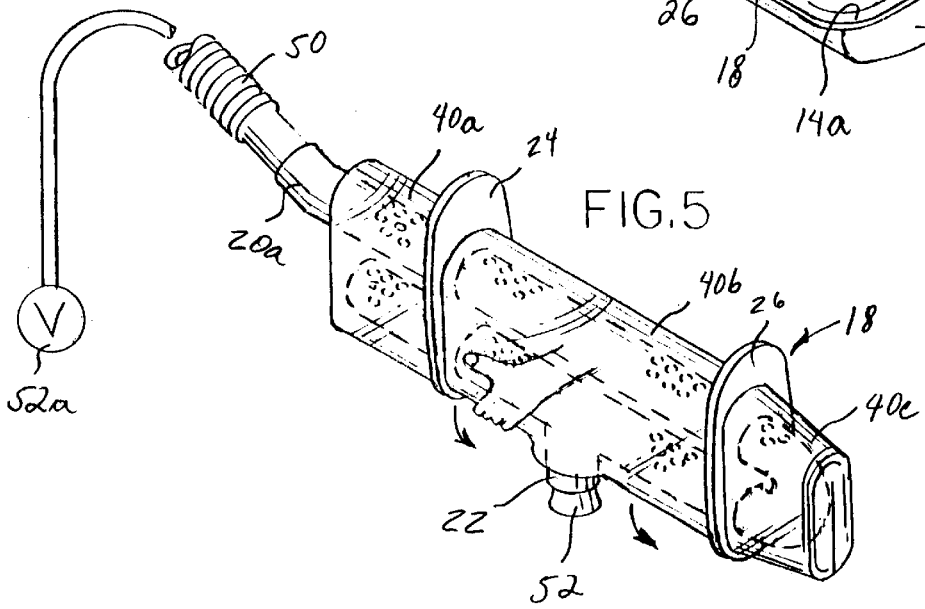
FIG. 5 is a perspective view illustrating three separate bags positioned about the internal structure of the first muffler.
Figure 9:
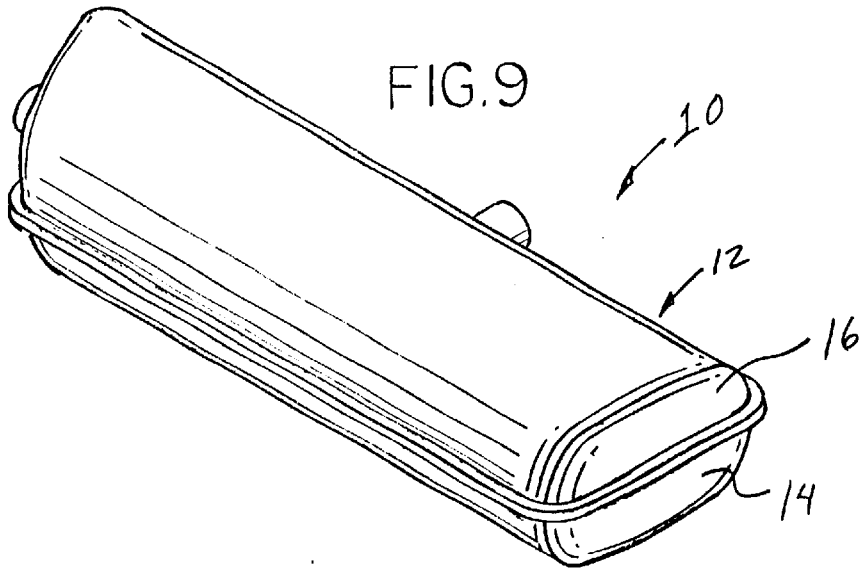
FIG. 9 is a view of the completed first muffler containing an internal structure/fibrous material-filled bag assembly.
Figure 10:
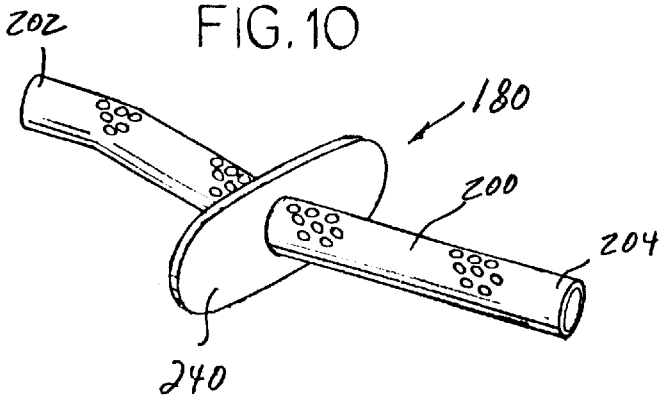
FIG. 10 is a perspective view of an internal structure forming part of a second muffler filled in accordance with a filling process of the present invention.

FIG. 9 illustrates a first clam shell type muffler 10 filled with fibrous material in accordance with a process of a first embodiment of the present invention. The muffler 10 comprises an outer shell 12 formed from first and second muffler shell outer parts 14 and 16. The first and second parts 14 and 16 define an internal cavity 17, see FIG. 6, when coupled together. An internal structure 18 is provided in the shell internal cavity 17, see FIGS. 3–6. In the illustrated embodiment, the structure 18 comprises a generally U-shaped perforated pipe 20, an inlet pipe 22 integral with the perforated pipe 20 so as to communicate with the pipe 20, and first and second partitions 24 and 26. The partitions 24 and 26 define first, second and third compartments 30*a*–30*c* within the internal cavity 17, see FIG. 6, and may be perforated so as to permit gases to pass between the compartments 30*a*–30*c*. As will be discussed further below, first, second and third fibrous material-filled bags 40*a*–40*c* are positioned about the internal structure 18 so as to be provided respectfully in the first, second and third compartments 30*a*–30*c*, see FIGS. 5 and 6.

A first exhaust pipe (not shown) extending between a vehicle engine and the muffler 10 is coupled to the inlet pipe 22. A second exhaust pipe (not shown) is coupled to an exit portion 20*a* of the perforated pipe 20. During operation of a vehicle to which the muffler 10 is attached, exhaust gases pass into the muffler via the first exhaust pipe. Acoustic energy generated by those gases passes through and from the perforated pipe 20 to the fibrous material which functions to dissipate a portion of that acoustic energy.

The first and second muffler shell outer parts 14 and 16 may be formed having any conventional and suitable shape. Further, the internal structure 18 may comprise one or more perforated pipes; one or more non-perforated pipes coupled to one or more perforated pipes; or one or more perforated elements, such as a triangular, rectangular or other geometric-shaped element coupled to one or more perforated or non-perforated pipes. It is also contemplated that the internal structure 18 may include 0, 1 or 3 or more partitions.

A process for incorporating the internal structure 18 and the fibrous material-filled bags 40*a*–40*c* into the muffler shell 12 will now be described.

Initially, a vacuum hose 50 is coupled to a vacuum source 52*a* and the exit portion 20*a* of the perforated pipe 20. When the vacuum source 52*a* is activated, it functions to pull air through perforations 20*b* provided in the pipe 20 via hose 50. A partial vacuum is then created within and surrounding the pipe 20. A plug 52 is provided in the inlet pipe 22 so as to prevent air from being drawn in through the pipe 22 and increase the quantity of air being drawn in through the pipe 20 during the fibrous material filling operation.

The fibrous material-filled bags 40*a*–40*c* are then positioned about the pipe 20, either manually or via an apparatus (not shown). The bags 40*a*–40*c* are located about the pipe 20 such that when the internal structure 18 and the bags 40*a*–40*c* are positioned within the internal cavity 17, the first, second and third bags 40*a*–40*c* fill the first, second and third internal cavity compartments 30*a*–30*c*, respectively, see FIGS. 4–6. Preferably, the vacuum source 52*a* is activated before initiation of the positioning step. However, the vacuum source 52*a* may be initiated at about the same time as or subsequent to the occurrence of the positioning step.

Figure 1:
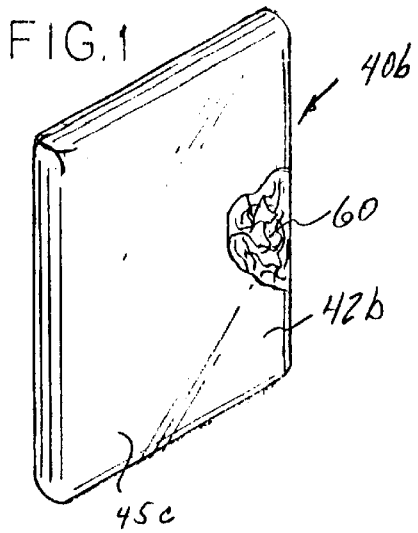
FIG. 1 is a perspective view of a non-perforated second side of a fibrous-filled bag used in a muffler filling process of the present invention.
Figure 2:
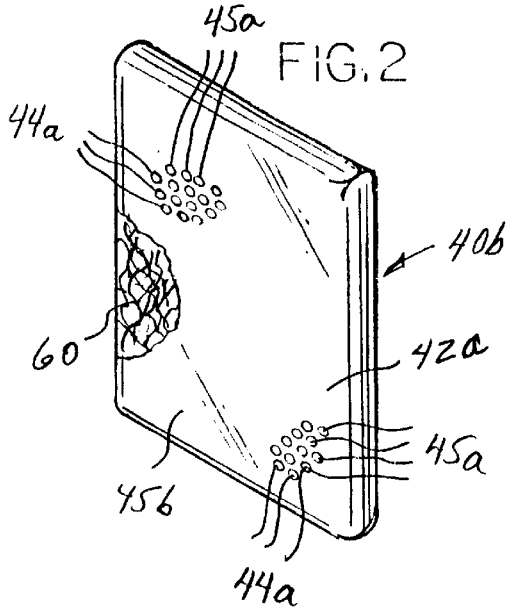
FIG. 2 is a perspective view a perforated first side of a fibrous-filled bag used in a muffler filling process of the present invention.
Figure 3:
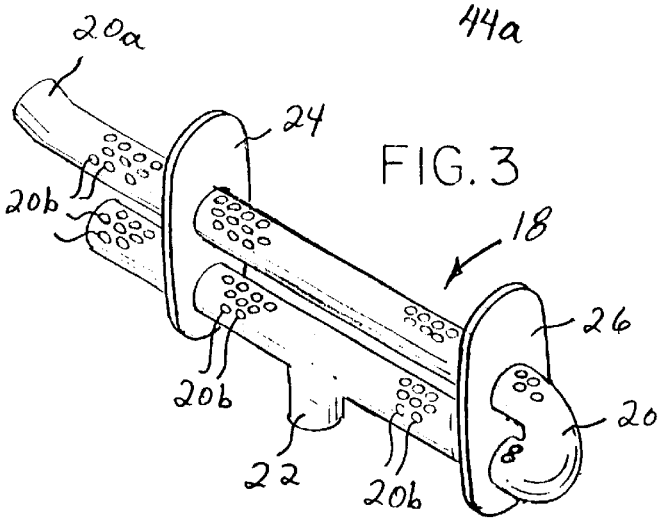
FIG. 3 is a perspective view of an internal structure forming part of a first muffler filled in accordance with a filling process of the present invention.
Figure 4:
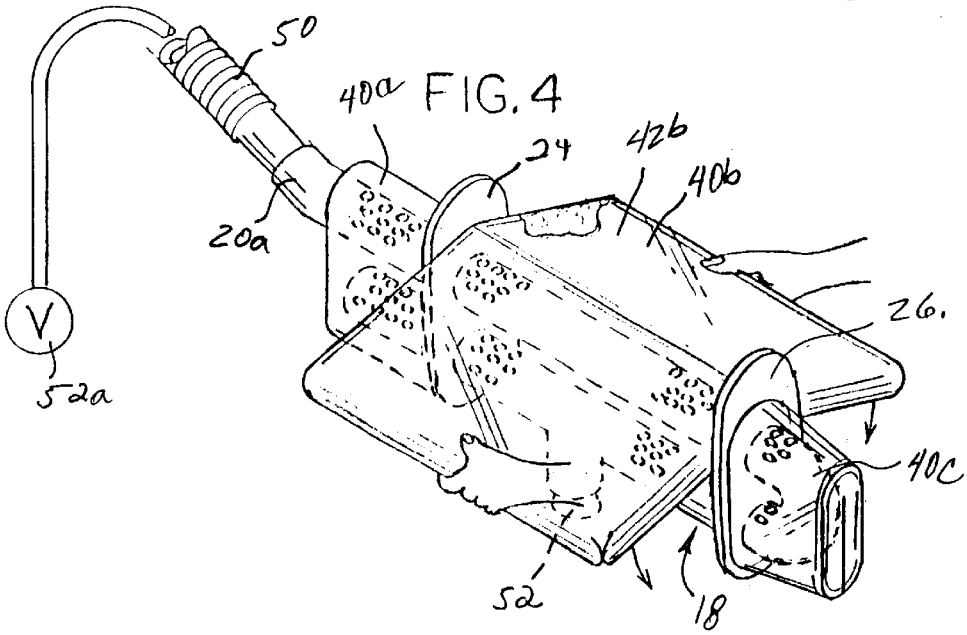
FIG. 4 is a perspective view illustrating a fibrous material-filled bag positioning step.

In the illustrated embodiment, the bags 40*a*–40*c* are constructed from the same material and in the same manner. However, they do differ in size so as to conform to the size of the internal cavity compartments 30*a*–30*c*. Hence, a description of bag 40*b*, illustrated in FIGS. 1 and 2, set out below is also applicable to the construction and make-up of bags 40*a* and 40*c*.

The bag 40*b* is formed from paper, a polymeric material, cardboard, fiberglass or any other suitable material. It comprises first and second sides 42*a* and 42*b*. The first side 42*a* of the bag 40*b* is provided with a plurality of first perforations 44*a*. The open areas defined by those perforations 44*a*, when summed together, define a first side total open area 45*a* in the bag first side 42*a*. In the illustrated embodiment, the bag second side 42*b* is provided with no perforations, see FIG. 1. However, it is contemplated that the bag second side 42*b* may comprise one or more second perforations. The open areas defined by those second perforations, when summed together, define a second side total open area in the bag second side 42*b*. The first side total open area 45*a* is greater than the second side total open area. For example, the first side total open area 45*a* may comprise between about 1% and 60% of the total surface area of the bag first side 42*a* while the second side total open area may comprise between about 0% and about 4% of the total surface area of the bag second side 42*b*. Accordingly, between about 40% and about 99% of the total surface area of the first side 42*a* of the bag 40*b* comprises a solid, non-open area 45*b* and is defined by the material from which the bag 40*b* is formed and between about 96% and 100% of the total surface area of the second side 42*b* of the bag 40*b* comprises a solid, non-open area 45*c* and is defined by the bag material.

Each bag 40*a*–40*c* is preferably filled with fibrous material 60. A conventional texturizing device (not shown) may be used to fill the bags 40*a*–40*c* by placing a nozzle of the device in an opening located in a corner or edge of each bag. Conventional texturizing devices are disclosed in U.S. Pat. Nos. 4,569,471 and 5,976,453, the disclosures of which are incorporated herein by reference. After the filling operation, the bag openings are sealed or otherwise closed.

The fibrous material 60 may be formed from one or more continuous glass filament strands, wherein each strand comprises a plurality of filaments. The filaments may be formed from E-glass or S-glass, or other glass compositions. For example, the continuous strand material may comprise an E-glass roving sold by Owens Coming under the trademark ADVANTEX® or an S-glass roving sold by Owens Coming under the trademark Zen Tron®. It is also contemplated that ceramic fibrous material or other mineral fibrous material may be used instead of glass fibrous material. Pressurized air injected into the texturizing device separates and entangles the filaments of the strand material so that the strand material emerges from the nozzle as a continuous length of "fluffed-up" or fibrous material 60. A sufficient quantity of fibrous material 60 is provided in each bag 40*a*–40*c* so as to allow the resultant muffler 10 to adequately perform its acoustic energy attenuation function. For example, each bag 40*a*–40*c* may be filled with a sufficient quantity of fibrous material 60 such that each corresponding internal cavity compartment 30*a*–30*c* is provided with between about 90–200 grams/liter of fibrous material 60. It is noted that during the initial operation of the vehicle to which the muffler 10 is assembled, the heated gases may burn or otherwise destroy the material from which each bag 40*a*–40*c* is formed such that only the fibrous material 60 remains in the shell internal cavity 17.

As noted above, it preferred that the vacuum source 52*a* be activated during the step of positioning the bags 40*a*–40*c* about the internal structure 18. The bags 40*a*–40*c* are positioned relative to the internal structure 18 such that the first side 42*a* of each bag 40*a*–40*c* faces the internal structure 18 while the second side 42*b* faces away from the internal structure 18. Because each of the bags 40*a*–40*c* is so positioned, has perforations 44*a* in the bag first side 42*a*, and either no perforations or only a limited total open area in the bag second side 42*b*, the partial vacuum created in the perforated pipe 20 causes the fibrous material-filled bags 40*a*–40*c* to be drawn inwardly towards and compacted against the pipe 20 during the positioning operation.

Figure 6:
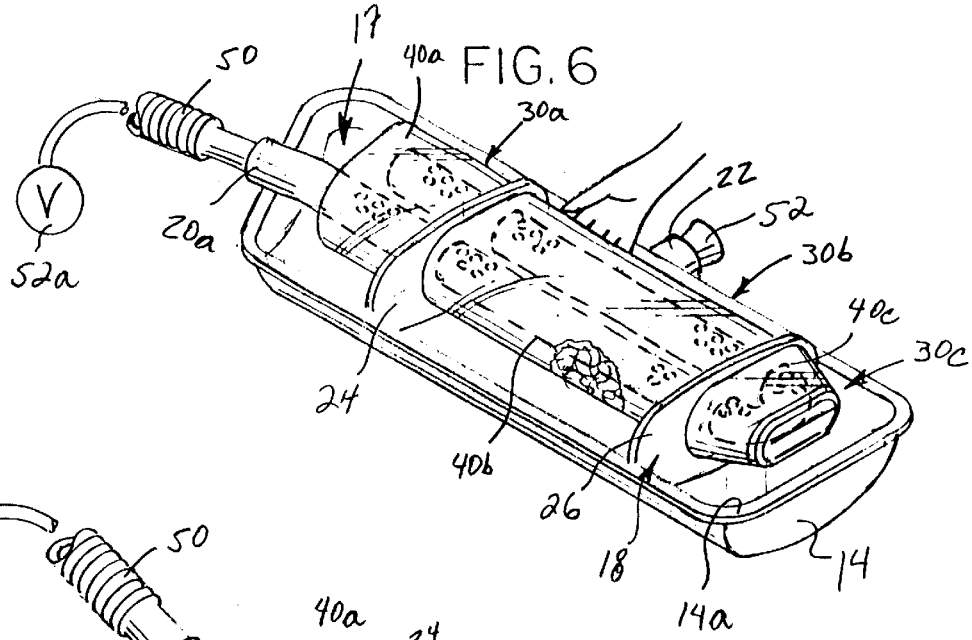
FIG. 6 is a perspective view illustrating the step of placing the internal structure/fibrous material-filled bag assembly of FIG. 5 into a first muffler shell outer part.
Figure 7:
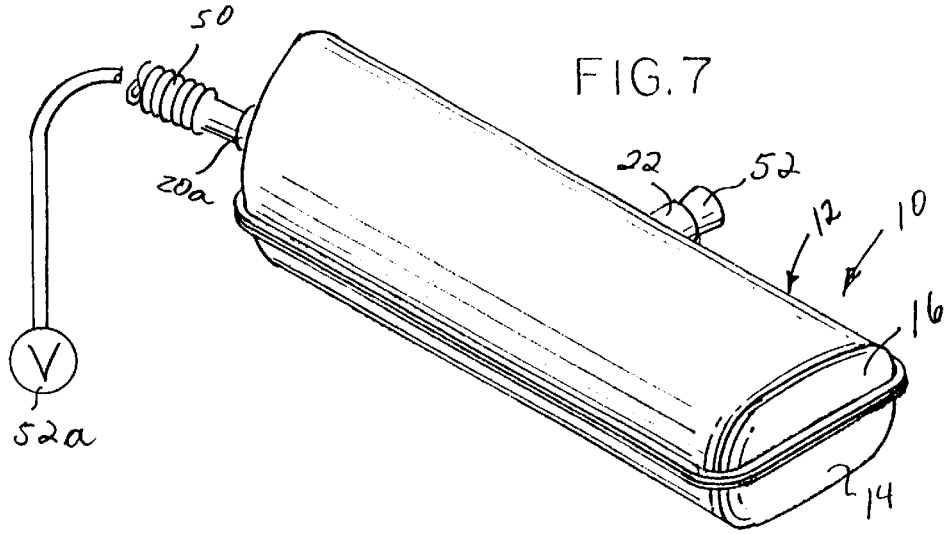
FIG. 7 is a perspective view illustrating a second muffler shell outer part positioned over the first muffler shell outer part containing the internal structure/fibrous material-filled bag assembly.
Figure 8:
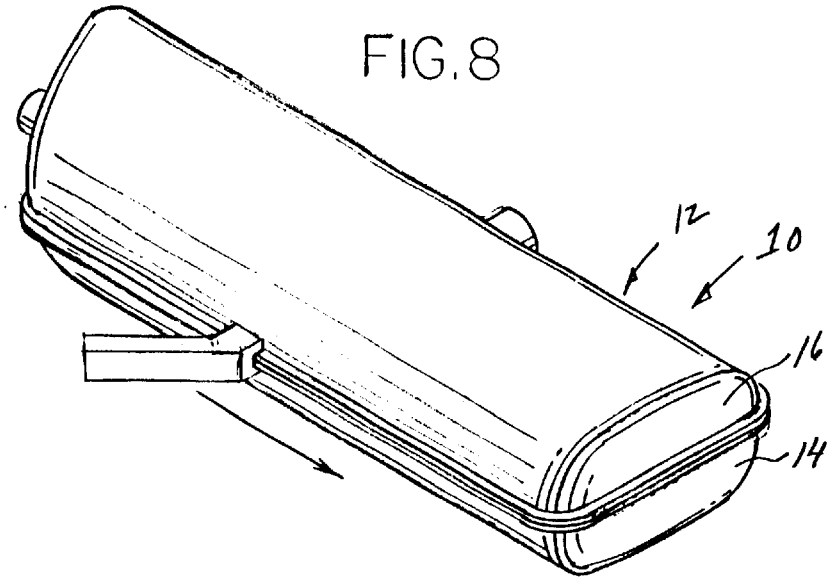
FIG. 8 is a perspective view illustrating a crimping operation to couple the first and second muffler shell outer parts to one another.

After the bags 40*a*–40*c* have been positioned about the perforated pipe 20 and drawn inwardly toward the pipe 20 via the partial vacuum created in the pipe 20, the bags 40*a*–40*c* and the internal structure 18 are positioned within the first muffler shell outer part 14, see FIG. 6. This step preferably occurs with the vacuum source 52*a* activated. If any portion of a bag 40*a*–40*c* extends beyond an outer edge 14*a* of the first muffler shell outer part 14, that bag portion is repositioned so that it resides entirely within the outer edge 14*a* of the first part 14. Thereafter, the second muffler shell outer part 16 is placed onto the first muffler shell outer part 14, see FIG. 7, which step preferably occurs with the vacuum source 52*a* activated, and joined to the first part 14 via a conventional welding operation or crimping operation, see FIG. 8.

The vacuum source 52*a* may be deactivated and the plug 52 removed prior to the crimping operation.

Figure 16:
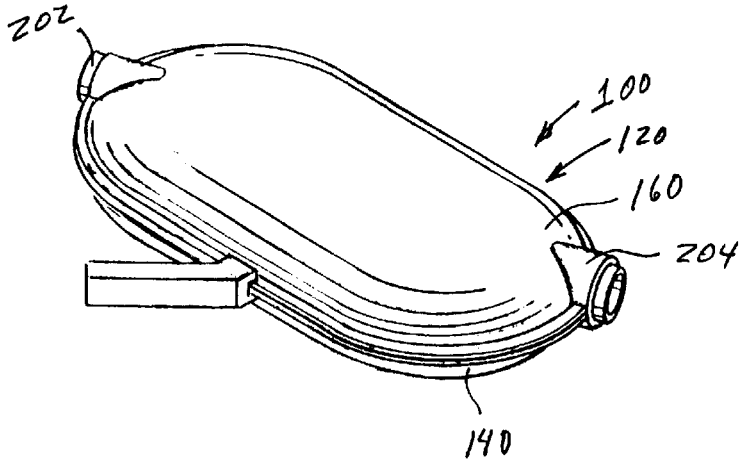
FIG. 16 is a perspective view illustrating a crimping operation to couple the first and second muffler shell outer parts to one another.
Figure 17:
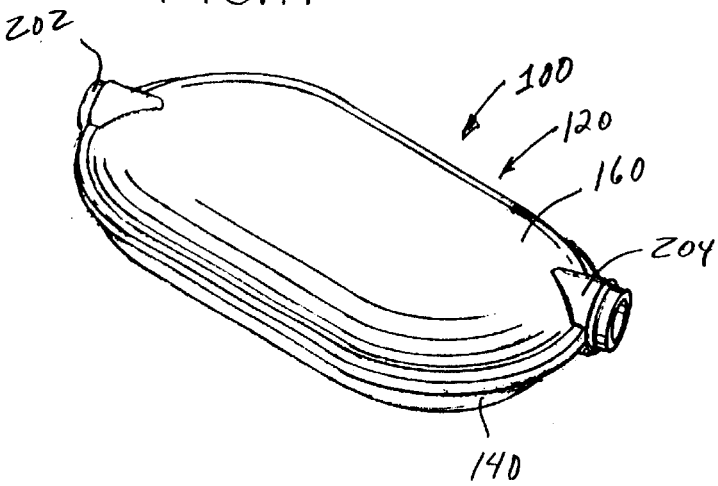
FIG. 17 is a view of the completed second muffler containing an internal structure/fibrous material-filled bag assembly.
Figure 18:
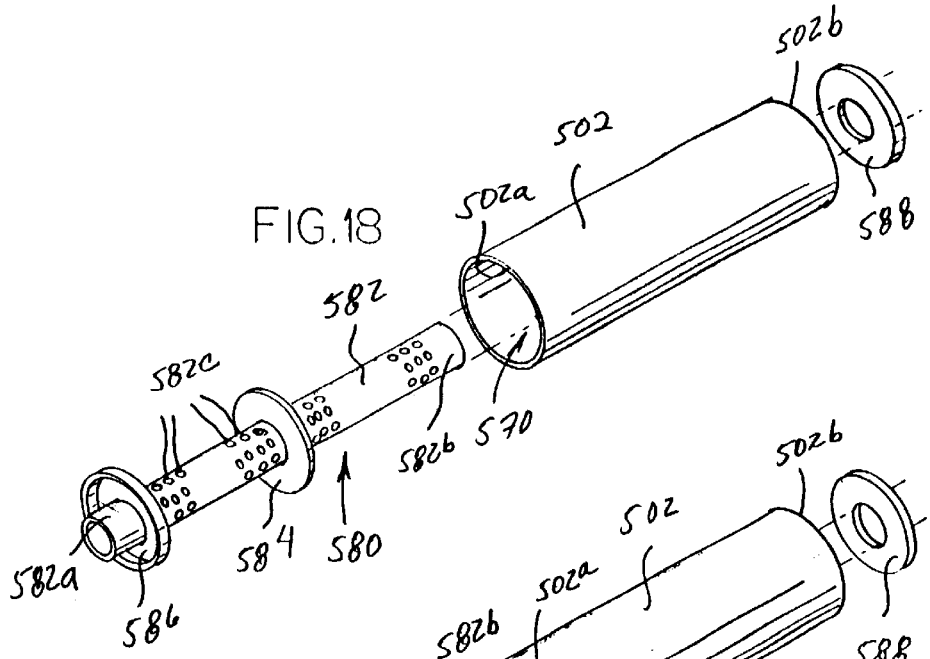
FIG. 18 is a perspective, exploded view of a third muffler.

FIG. 17 illustrates a second clam shell type muffler 100 filled with fibrous material in accordance with a process of a second embodiment of the present invention. In FIGS. 10–17, like elements, previously referred to above, are referenced by like reference numerals. The muffler 100 comprises an outer shell 120 formed from first and second muffler shell outer parts 140 and 160. The first and second parts 140 and 160 define an internal cavity 170, see FIG. 14, when coupled together. An internal structure 180 is provided in the shell internal cavity 170, see FIGS. 11–14. In the illustrated embodiment, the structure 180 comprises a perforated pipe 200 and a partition 240. The partition 240 defines first and second compartments 300*a* and 300*b* within the internal cavity 170 and may be perforated so as to permit gases to pass between the compartments 300*a*–300*b*. As will be discussed further below, first and second fibrous material-filled bags 400*a* and 400*b* are positioned about the internal structure 180 so as to be provided respectfully in the first and second compartments 300*a* and 300*b*, see FIG. 14.

A first exhaust pipe (not shown) extending between a vehicle engine and the muffler 100 is coupled to an entrance portion 202 of the pipe 200. A second exhaust pipe (not shown) is coupled to an exit portion 204 of the perforated pipe 200. During operation of a vehicle to which the muffler 100 is attached, exhaust gases pass into the muffler 100 via the first exhaust pipe. Acoustic energy generated by those gases passes through and from the perforated pipe 200 to the fibrous material which functions to dissipate a portion of that acoustic energy.

The first and second muffler shell outer parts 140 and 160 may be formed having any conventional and suitable shape. Further, the internal structure 180 may comprise two or more perforated pipes; one or more non-perforated pipes coupled to one or more perforated pipes; or one or more perforated elements, such as a triangular, rectangular or other geometric-shaped element coupled to one or more perforated or non-perforated pipes. It is also contemplated that the internal structure 180 may include 0 or 2 or more partitions.

A process for incorporating the internal structure 180 and the fibrous material-filled bags 400*a* and 400*b* into the muffler shell 120 will now be described.

Figure 11:
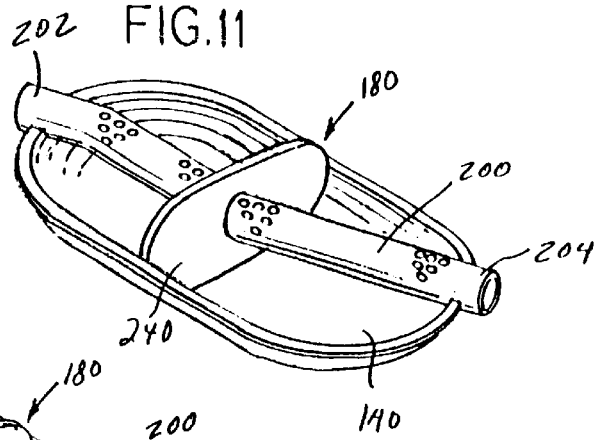
FIG. 11 is a perspective view illustrating the internal structure of FIG. 10 positioned in a first muffler shell outer part of the second muffler.
Figure 12:
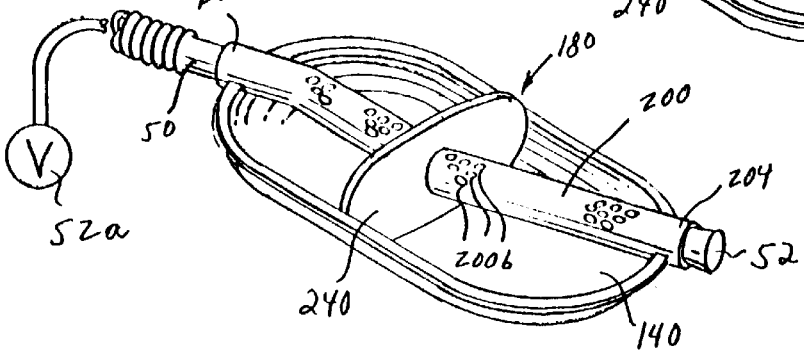
FIG. 12 is a perspective view similar to FIG. 11 illustrating a vacuum source coupled to the internal structure for drawing a partial vacuum through the internal structure.

Initially, the internal structure 180 is positioned within the first muffler shell outer part 140, see FIG. 11. Thereafter, a vacuum hose 50 is coupled to a vacuum source 52*a* and the entrance portion 202 of the perforated pipe 200, see FIG. 12. When the vacuum source 52*a* is activated, it functions to pull air through perforations 200*b* provided in the pipe 200 via hose 50. A partial vacuum is then created within and surrounding the pipe 200. A plug 52 is provided in the exit portion 204 of the pipe 200 so as to prevent air from being drawn in through the pipe exit portion 204 and to increase the quantity of air being drawn in through perforations 200*b* in the pipe 200 during the fibrous material filling operation.

Figure 13:
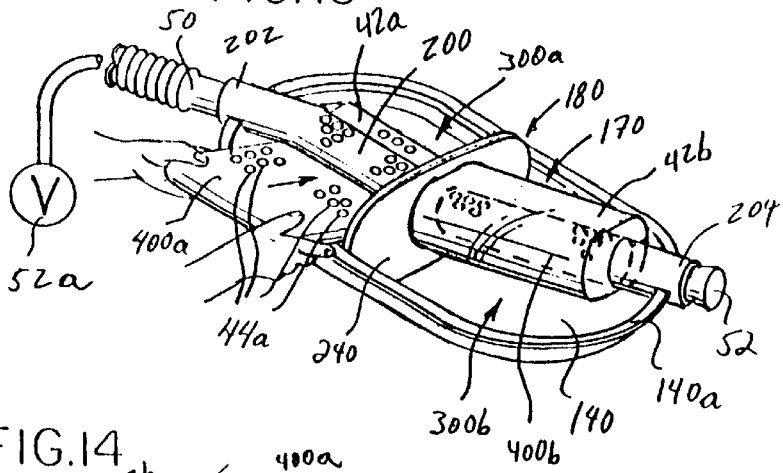
FIGS. 13 and 14 are perspective views illustrating the step of positioning first and second fibrous material-filled bags about the internal structure of the second muffler.
Figure 14:
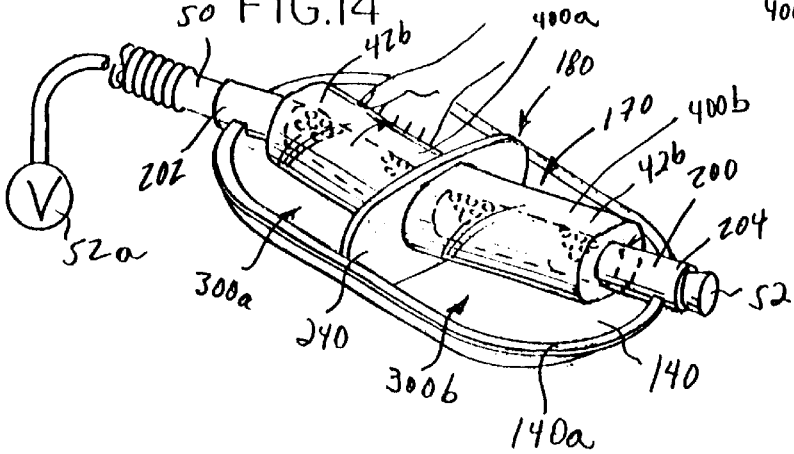

The fibrous material-filled bags 400*a* and 400*b* are then positioned about the pipe 200, either manually or via an apparatus (not shown), see FIGS. 13 and 14. Preferably, bag 400*a* is positioned about the pipe 200 prior to the bag 400*b* being positioned about the pipe 200 to take advantage of the increased level of vacuum in the section of the pipe 200 receiving bag 400*a* as that pipe section is nearest to the vacuum source 52*a*. The bags 400*a* and 400*b* are separated from one another by the partition 240 so as to be positioned in and fill the compartments 300*a* and 300*b*. Preferably, the vacuum source 52*a* is activated before initiation of the positioning step. However, the vacuum source 52*a* may be initiated at about the same time as or subsequent to the occurrence of the positioning step.

The bags 400*a* and 400*b* are constructed from the same material and have the same features as bags 40*a*–40*c* described above. Further, the bags 400*a* and 400*b* are filled with the same fibrous material 60 as the bags 40*a*–40*c*. Hence, the description of bags 40*a*–40*c* and fibrous material 60 is also applicable to the construction and make-up of bags 400*a* and 400*b* and the fibrous material provided therein.

The bags 400*a* and 400*b* are positioned such that the first side 42*a*, i.e., the side having perforations 44*a*, of each bag 400*a* and 400*b* faces the internal structure 180 while the second side 42*b* faces away from the internal structure 180. Because each of the bags 400*a* and 400*b* is so positioned, has perforations 44*a* in the bag first side 42*a*, and either no perforations or a limited number of perforations in the bag second side 42*b*, the partial vacuum created in the perforated pipe 200 causes the fibrous material-filled bags 400*a* and 400*b* to be drawn inwardly towards and compacted against the pipe 200 during the positioning operation.

If any portion of a bag 400*a* and 400*b* extends beyond an outer edge 140*a* of the first muffler shell outer part 140, that bag portion is repositioned so that it resides entirely within the outer edge 140*a* of the first part 140.

Figure 15:
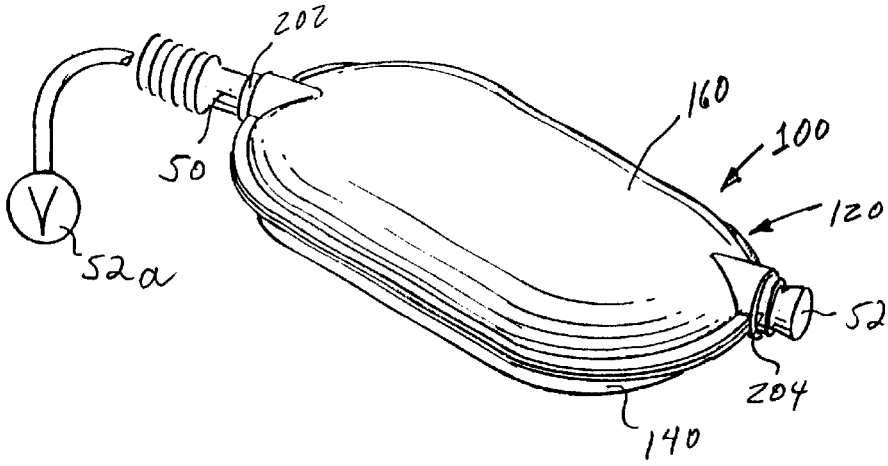
FIG. 15 is a perspective view illustrating a second muffler shell outer part positioned over the first muffler shell outer part containing the internal structure/fibrous material-filled bag assembly.

After the bags 400*a* and 400*b* are fully positioned within the first muffler shell outer part 140, the second muffler shell outer part 160 is placed onto the first muffler shell outer part 140, see FIG. 15, and joined to the first part 140 via a conventional welding operation or crimping operation, see FIG. 16.

The vacuum source 52*a* may be deactivated and the plug 52 removed prior to the crimping operation.

Figure 21:
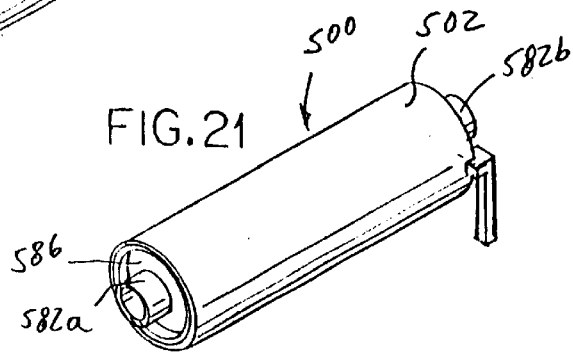
FIG. 21 is a view illustrating a crimping operation to couple an end cap to the main shell portion.

FIG. 21 illustrates a non-clam shell type muffler 500 filled with fibrous material in accordance with a process of a third embodiment of the present invention. In FIGS. 18–21, like elements, previously referred to above, are referenced by like reference numerals. The muffler 500 comprises a generally cylindrical main shell portion 502 which defines an internal cavity 570, see FIG. 18. An internal structure 580 is provided in the shell internal cavity 570. In the illustrated embodiment, the structure 580 comprises a perforated pipe 582 and a partition 584. The partition 584 defines first and second compartments 590*a* and 590*b* within the internal cavity 570 and may be perforated so as to permit gases to pass between the compartments 590*a* and 590*b*. As will be discussed further below, first and second fibrous material-filled bags 600*a* and 600*b* are positioned about the internal structure 580 so as to be provided respectfully in the first and second compartments 590*a* and 590*b*, see FIG. 19.

A first exhaust pipe (not shown) extending between a vehicle engine and the muffler 500 is coupled to an entrance portion 582*a* of the pipe 582. A second exhaust pipe (not shown) is coupled to an exit portion 582*b* of the perforated pipe 582. During operation of a vehicle to which the muffler 500 is attached, exhaust gases pass into the muffler 500 via the first exhaust pipe. Acoustic energy generated by those gases passes through and from the perforated pipe 582 to the fibrous material which functions to dissipate a portion of that acoustic energy.

The main shell portion 502 may be formed having any conventional and suitable shape. Further, the internal structure 580 may comprise two or more perforated pipes; one or more non-perforated pipes coupled to one or more perforated pipes; or one or more perforated elements, such as a triangular, rectangular or other geometric-shaped element coupled to one or more perforated or non-perforated pipes. It is also contemplated that the internal structure 580 may include 0 or 2 or more partitions.

A process for incorporating the internal structure 580 and the fibrous material-filled bags 600*a* and 600*b* into the muffler shell 502 will now be described.

Figure 19:
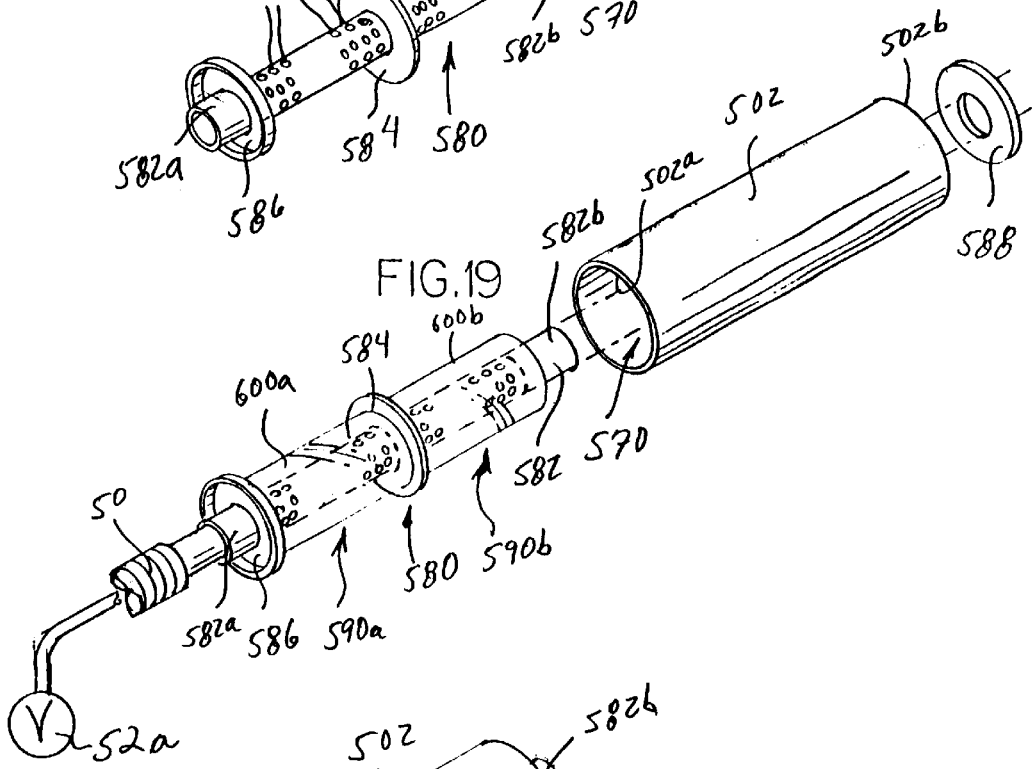
FIG. 19 is a view illustrating first and second fibrous material-filled bags positioned about an internal structure of the muffler illustrated in FIG. 18.
Figure 20:
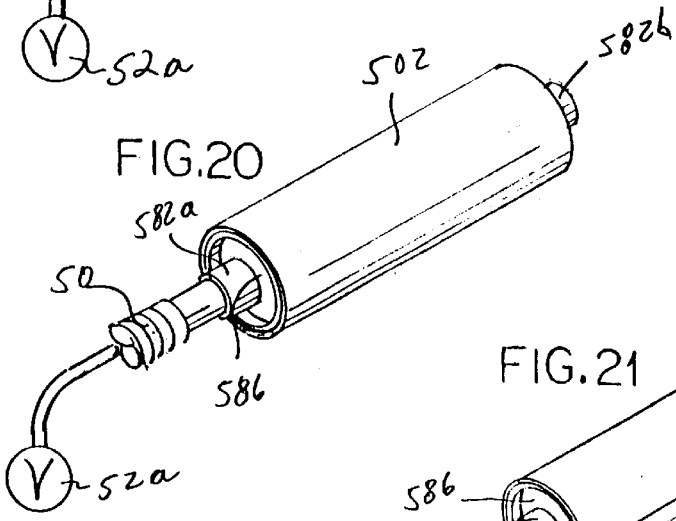
FIG. 20 is a view showing the internal structure/fibrous material-filled bag assembly positioned within a generally cylindrical main shell portion of a muffler housing.

Initially, a vacuum hose 50 is coupled to a vacuum source 52*a* and the entrance portion 582*a* of the perforated pipe 582, see FIG. 19. When the vacuum source 52*a* is activated, it functions to pull air through perforations 582*c* provided in the pipe 582 via hose 50. A partial vacuum is then created within and surrounding the pipe 582. A plug (not shown) may be provided in the exit portion 582*b* of the pipe 582 so as to prevent air from being drawn in through the exit portion 582*b* and to increase the quantity of air being drawn in through perforations 582*c* in the pipe 582 during the fibrous material filling operation.

The fibrous material-filled bags 600*a* and 600*b* are then positioned about the pipe 582, either manually or via an apparatus (not shown), see FIG. 19. The bags 600*a* and 600*b* are separated from one another by the partition 584 so as to fill the compartments 590*a* and 590*b*. Preferably, the vacuum source 52*a* is activated before initiation of the positioning step. However, the vacuum source 52*a* may be initiated at about the same time as or subsequent to the occurrence of the positioning step.

The bags 600*a* and 600*b* are constructed from the same material and in the same manner as bags 40*a*–40*c* described above. Further, the bags 600*a* and 600*b* are filled with the same fibrous material 60 as the bags 40*a*–40*c*. Hence, the description of bags 40*a*–40*c* and fibrous material 60 is also applicable to the construction and make-up of bags 600*a* and 600*b*.

The bags 600*a* and 600*b* are positioned such that their first sides, i.e., the sides having perforations, face the internal structure 580 while the second sides face away from the internal structure 580. Because each of the bags 600*a* and 600*b* is so positioned, has perforations in the bag first side, and either no perforations or only a limited total open area in the bag second side, the partial vacuum created in the perforated pipe 582 causes the fibrous material-filled bags 600*a* and 600*b* to be drawn inwardly towards and compacted against the pipe 582.

After the bags 600*a* and 600*b* have been positioned about the perforated pipe 582 and drawn inwardly toward the pipe 582 via the partial vacuum created in the pipe 582, the bags 600*a* and 600*b* and the internal structure 580 are positioned within the main shell portion 502. Thereafter, a first end cap 586 and a second end cap 588 are positioned over the entrance and exit portions 582*a* and 582*b* of the pipe 582, abutted against first and second outer edges 502*a* and 502*b* of the main portion 502 and coupled to the main portion 502 via a conventional welding operation or crimping operation, see FIG. 21.

The vacuum source 52*a* may be deactivated and the plug removed prior to the crimping operation.

It is also contemplated that only one or two fibrous material-filled bags may be positioned about internal structure 18 in the FIG. 6 embodiment and only one fibrous material-filled bag may be positioned about internal structure 180 in the FIG. 13 embodiment or internal structure 580 in the FIG. 19 embodiment.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A process for filling a muffler shell with fibrous material comprising the steps of:

providing a muffler shell comprising one or more muffler shell outer parts which define an internal cavity and an internal structure adapted to extend at least part way through the shell internal cavity and having one or more openings adapted to communicate with the shell internal cavity;

providing a bag filled with fibrous material, said bag having a first side with one or more first perforations defining a first side total open area and a second side with either no perforations or one or more second perforations defining a second side total open area, said first open area being greater than said second open area;

positioning said fibrous material-filled bag adjacent said internal structure such that said first side is nearest to said internal structure; and drawing a partial vacuum through said internal structure, said partial vacuum drawing said fibrous-filled bag inwardly towards said internal structure.

2. A process as set forth in claim 1, where said partial vacuum is drawn prior to or at about the same time as the occurrence of said positioning step.

3. A process as set forth in claim 1, wherein said partial vacuum is drawn subsequent to said positioning step.

4. A process as set forth in claim 1, wherein said muffler shell comprises first and second muffler shell outer parts and further comprising the steps of:

placing said internal structure in said first muffler shell outer part subsequent to said positioning step and while said partial vacuum is being drawn through said internal structure;

placing said second muffler shell outer part adjacent to said first muffler shell outer part such that said first and second muffler shell parts define an internal cavity containing said internal structure, and said fibrous material-filled bag; and joining said first and second muffler shell parts to one another.

5. A process as set forth in claim 1, wherein said muffler shell comprises first and second muffler shell outer parts and further comprising the steps of:

placing said internal structure in said first muffler shell outer part prior to said positioning step;

placing said second muffler shell outer part adjacent to said first muffler shell outer part subsequent to said positioning step such that said first and second muffler shell parts define an internal cavity containing said internal structure, and said fibrous material-filled bag; and joining said first and second muffler shell parts to one another.

6. A process as set forth in claim 1, wherein said fibrous material in said bag comprises a mineral fiber wool-type product.

7. A process as set forth in claim 1, wherein said step of drawing a partial vacuum through said internal structure comprises the step of connecting a vacuum source to said internal structure.

8. A process as set forth in claim 1, wherein said bag is formed from a polymeric material.

9. A process as set forth in claim 1, wherein said internal structure comprises at least one perforated element.

10. A process as set forth in claim 1, wherein said first side total open area comprises between about 1% and 60% of said first side of said bag and said second side total open area comprises between about 0% to about 4% of said second side of said bag.

11. A process as set forth in claim 1, wherein said muffler shell comprises a generally cylindrical main shell portion and further comprising the step of placing said internal structure in said generally cylindrical main shell portion subsequent to said positioning step and while said partial vacuum is being drawn through said internal structure.

12. A muffler comprising:

a muffler shell comprising one or more muffler shell outer parts which define an internal cavity;

an internal structure adapted to extend at least part way through the shell internal cavity and having one or more openings communicating with the shell internal cavity; and a fibrous-filled bag positioned in said internal cavity, said bag having a first side with one or more first perforations defining a first side total open area and a second side with either no perforations or one or more second perforations defining a second side total open area, said first open area being greater than said second open area.

13. A muffler as set forth in claim 12, wherein said internal structure comprises at least one perforated element.

14. A muffler as set forth in claim 12, wherein said fibrous material comprises a mineral fiber wool-type product.

15. A muffler as set forth in claim 12, wherein said first side total open area comprises between about 1% and 60% of said first side of said bag and said second side total open area comprises between about 0% to about 4% of said second side of said bag.

16. A muffler as set forth in claim 12, wherein said first side of said bag is nearest said internal structure.

17. A muffler as set forth in claim 12, wherein said first side total open area comprises between about 1% and 60% of a total surface area of said first side of said bag and said second side total open area comprises between about 0% to about 4% of a total surface area of said second side of said bag.

* * * * *